US010214460B2

(12) United States Patent
Rambow

(10) Patent No.: US 10,214,460 B2
(45) Date of Patent: Feb. 26, 2019

(54) BOOSTER COMPOSITION

(71) Applicant: TK Holdings Inc., Armada, MI (US)

(72) Inventor: Scott M. Rambow, Roseville, MI (US)

(73) Assignee: Joyson Safety Systems Acquisition LLC, Auburn Hills, MI (US)

( * ) Notice: Subject to any disclaimer, the term of this patent is extended or adjusted under 35 U.S.C. 154(b) by 137 days.

(21) Appl. No.: 14/732,648

(22) Filed: Jun. 5, 2015

(65) Prior Publication Data

US 2015/0353437 A1 Dec. 10, 2015

Related U.S. Application Data

(60) Provisional application No. 62/008,166, filed on Jun. 5, 2014.

(51) Int. Cl.

| | |
|---|---|
| ***C06B 47/10*** | (2006.01) |
| ***C06B 29/02*** | (2006.01) |
| ***C06B 43/00*** | (2006.01) |
| ***C06C 9/00*** | (2006.01) |
| ***C06D 5/06*** | (2006.01) |
| ***C06B 23/00*** | (2006.01) |
| *D03D 23/00* | (2006.01) |
| *D03D 43/00* | (2006.01) |

(52) U.S. Cl.
CPC ..... *C06B 29/02* (2013.01); *C06B 23/005* (2013.01); *C06B 43/00* (2013.01); *C06C 9/00* (2013.01); *C06D 5/06* (2013.01)

(58) Field of Classification Search
USPC ..... 149/22, 109.2, 109.4
See application file for complete search history.

(56) References Cited

U.S. PATENT DOCUMENTS

| | | | | |
|---|---|---|---|---|
| 3,009,800 | A | 11/1961 | Swimmer | |
| 4,806,180 | A | 2/1989 | Goetz et al. | |
| 6,132,480 | A | 10/2000 | Barnes et al. | |
| 6,416,599 | B1 * | 7/2002 | Yoshikawa | C06D 5/06 149/45 |
| 8,282,749 | B1 * | 10/2012 | Sabatini | C06B 33/04 149/109.2 |
| 8,282,750 | B1 | 10/2012 | Rambow et al. | |
| 9,255,040 | B1 | 2/2016 | Shaw et al. | |
| 2003/0146922 | A1 | 8/2003 | Taylor et al. | |
| 2004/0069383 | A1 * | 4/2004 | Sato | C06B 29/22 149/78 |

(Continued)

FOREIGN PATENT DOCUMENTS

EP 0952131 A1 10/1999

OTHER PUBLICATIONS

International Search Report and Written Opinion issued in International Application No. PCT/US2015/034585 dated Aug. 26, 2015.

(Continued)

*Primary Examiner* — James E McDonough
(74) *Attorney, Agent, or Firm* — Meunier Carlin & Curfman LLC

(57) ABSTRACT

An improved ignition and/or booster composition contains a boron-containing constituent such as boron carbide or a metal boride, and, an oxidizer such as potassium perchlorate. A gas generator and a vehicle occupant protection system containing the composition are also included.

16 Claims, 1 Drawing Sheet

(56) References Cited

U.S. PATENT DOCUMENTS

2004/0256038 A1* 12/2004 Wood ..... C06B 27/00
149/19.3
2012/0180692 A1* 7/2012 Hironaka ..... B60R 21/264
102/530
2013/0228254 A1* 9/2013 Marlin ..... C06B 21/0066
149/2

OTHER PUBLICATIONS

International Preliminary Report on Patentability issued in International Application No. PCT/US2015/034585 dated Dec. 15, 2016.

* cited by examiner

BOOSTER COMPOSITION

CROSS-REFERENCE TO RELATED APPLICATIONS

This application claims the benefit of U.S. Provisional Application Ser. No. 61/008,166 filed on Jun. 5, 2014.

TECHNICAL FIELD

The present invention relates generally to gas generating systems, and to an improved booster composition with high heat of combustion.

BACKGROUND OF THE INVENTION

The present invention relates to vehicle occupant protection systems or other safety systems employing gas generators to actuate an inflatable cushion for example. U.S. Pat. Nos. 5,035,757, 5,872,329, 6,074,502, 6,210,505, 6,287,400, 7,959,749, 6,189,927, 5,062,367, and 5,308,588 exemplify known pyrotechnic gas generating compositions and/or known gas generators and their operating environments, whereby each patent is herein incorporated by reference in its entirety. The pyrotechnic means typically include an initiator or igniter, and a gas generating composition ignitable by the igniter once the actuator is activated. The use of a booster composition, in addition to a gas generating composition, provides an environment for efficient combustion of the gas generating composition. Namely, the booster composition typically provides an increase in pressure and an increase in heat thereby providing conditions desirable for optimum combustion of the gas generating composition. Accordingly, high heat from the booster composition facilitates efficient combustion of the gas generant composition even at lower relative pressures and cooler temperature.

Certain booster compositions incorporate boron potassium nitrate or BKNO3. One concern with some compounds containing elemental boron is the impact and/or friction sensitivity of the respective composition containing the elemental boron. It would therefore be an improvement in the art to develop an ignition and/or booster compound and/or composition that does not have the impact and friction sensitivity concerns of known booster compositions, thereby improving shipping, handling and processing concerns of the booster composition during the manufacturing of an associated inflator or gas generator for example.

SUMMARY OF THE INVENTION

A composition contains a boron-containing compound such as boron carbide or a metal boride and may be provided at about 5-30 weight percent of the composition. At least one oxidizer such as potassium perchlorate or potassium nitrate may be provided at about 40-95 weight percent of the composition. If desired, a secondary oxidizer may be provided at about 0-30 weight percent of the composition, and more specifically, at about 0.1-30 weight percent when actually integrated into the composition. Further, if desired, an optional secondary fuel may be contained within the composition and may be selected from tetrazoles, triazoles, carboxylic acid, hydrazides, triazines, urea derivatives, and guanidines, and salts and derivatives of each type of fuel, and mixtures thereof. The optional secondary fuel may be provided at about 0-30 weight percent of said composition, and more specifically, at about 0.1-30 weight percent when actually integrated into the composition. A gas generator and a vehicle occupant protection system containing the composition are also provided. It has been found that compositions of the present invention advantageously maintain favorable ballistic performance characteristics such as a similar time to first gas that is typically exhibited with the use of an igniter composition such as BKNO3. However, the boron carbides and metallic borides of the present invention, when combined with the other pyrotechnic constituents, provides a marked improvement in the safe handling of the compositions during manufacture and transport, for example. As described herein, the impact and/or friction sensitivity of the present compositions is substantially improved as compared to the use of elemental boron with potassium nitrate, for example.

DETAILED DESCRIPTION OF THE INVENTION

Figure 1:
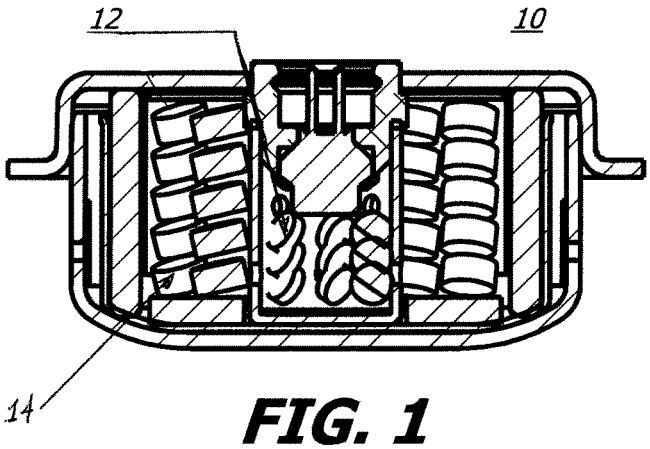
FIG. 1 is an exemplary embodiment of a gas generator in accordance with the present invention.

The present invention relates to booster compositions formed to have a relatively reduced friction and/or impact sensitivity as compared to known booster compositions containing $BKNO_3$. Each composition contains a boron-containing compound or constituent. For example, it has been discovered that boron carbide ($B_4C$) can be used as an alternative to boron in igniter and booster formulations. As a replacement to boron, it produces over 1900 cal/g in N2 in a Parr bomb. One preferred embodiment or formulation is a ratio of about 4:1 $KClO_4$:$B_4C$ by weight. The formulation is stable after heat age conditioning at 107 C for 408 hours and ignites above 500 C. The compositions of the present invention have been found to be insensitive to impact and friction up to 15 inches and 360 N, respectively, as tested as known in the art. Other boron-containing constituents include metal borides such as transitional metal borides, including but not limited to a metal boride selected from titanium boride, tungsten boride, magnesium boride, nickel boride, and mixtures thereof. It has been found that metal borides, just as with boron carbide, also produce high heats of combustion with $KClO_4$ and $KNO_3$.

It is contemplated that if desired, other typical gas generating constituents such as, but not limited to the following, may be combined with the novel compositions described above. These constituents may include secondary fuels selected from tetrazoles, triazoles, carboxylic acids, hydrazides, triazines, urea derivatives, and guanidines, and salts and derivatives of each type of fuel, and mixtures thereof; oxidizers selected from nonmetal or metal (alkali, alkaline earth, and/or transitional metal) nitrates, nitrites, chlorates, perchiorates, and oxides, and mixtures thereof; and other known additives useful in booster compositions. Fuels such as monoammonium salt of bis-tetrazole amine, 5-aminotetrazole, guanidine nitrate, d,l-tartaric acid, nitroguanidine, di-ammonium salt of 5'5-bis-1H-tetrazole, ammonium dinitrosalicylic acid, and mixtures thereof, exemplify typical fuels. Perchlorates and nitrates such as potassium perchlorate, ammonium perchlorate, potassium nitrate, ammonium nitrate, phase stabilized ammonium nitrate, and mixtures thereof, exemplify typical oxidizers. The primary fuel, $B_4C$ for example, may be provided at about 5-30 weight percent of the total composition. The oxidizer, as exemplified above, but preferably $KClO_4$, may be provided at about 40-95 weight percent of the total composition. In a preferred embodiment, when the boron-containing compound such as boron carbide, $B_4C$, and the oxidizer such as potassium perchlorate, $KClO_4$, are the only constituents, then the oxidizer may be provided at 70-90 weight percent of the total composition and the boron-containing compound may be provided at 10-30 weight percent of the total composition. If desired, the optional secondary fuel may be provided at about 0-30 weight percent, and when provided, at 0.1-30 weight percent of the total composition. If desired, a secondary oxidizer, as described herein, may be optionally provided at 0-30 weight percent, and when provided, at 0.1-30 weight percent of the total composition. The substitution reactants and the various typical booster or gas generant constituents described herein, may be provided by companies such as Aldrich Chemical Company or Fisher, for example. The constituents of the present compositions may be made in a known manner, by comminuting and dry mixing the constituents to form a substantially uniform and homogeneous composition, for example.

The following examples and comparative examples illustrate but do not limit the present inventive compositions.

COMPARATIVE EXAMPLE 1

A composition containing boron at 24 weight percent and potassium nitrate at 76 weight percent, the percentages taken by weight of the total composition, was comminuted and dry-mixed to form a substantially evenly distributed or homogeneous solid mixture. The composition was placed in a known inflator (as illustrated by FIG. 1), with a known igniter (130 mg), and ignited. The time to first gas at 85 C was calculated to be 3.3 milliseconds. An identical inflator with the same igniter was again loaded with the same composition. At 23 C, the time to first gas was calculated to be 4.0 milliseconds. An identical inflator with the same igniter was again loaded with the same composition. At −40 C, the time to first gas was calculated to be 4.1 milliseconds. The BOE or Bruceton impact sensitivity of this composition (tested as known in the art and similarly determined in the examples incorporating such data) was 1.9 inches.

COMPARATIVE EXAMPLE 2

A composition containing boron at 20 weight percent, potassium nitrate at 65 weight percent, and guanidine nitrate at 15 weight percent, the percentages taken by weight of the total composition, was comminuted and dry-mixed to form a substantially evenly distributed or homogeneous solid mixture. The composition was placed in an identical inflator of Example 1 with an identical igniter of Example 1 and ignited. The time to first gas at −40 C was calculated to be 2.8 milliseconds.

EXAMPLE 3

A composition containing boron carbide at 20 weight percent and potassium nitrate at 80 weight percent, the percentages taken by weight of the total composition, was comminuted and dry-mixed to form a substantially evenly distributed or homogenous solid mixture. The composition was placed in an identical inflator of Example 1 with the identical igniter of Example 1 (130 mg) and ignited. The time to first gas at 85 C was 7.6 milliseconds. The time to first gas at −40 C was 17.4 milliseconds. The inflator of Example 1 having an igniter having 230 mg, was loaded with the same composition and ignited. The time to first gas at −40 C was 7.1 milliseconds. The inflator of Example 1 having an igniter having 310 mg, was loaded with the same composition and ignited. The time to first gas at −40 C was 3.7 milliseconds. The Bruceton impact sensitivity of this composition was greater than 15 inches. The friction sensitivity as measured by the BAM friction test (tested as known in the art and similarly determined in the examples containing this data) was greater than 360 N.

EXAMPLE 4

An ignition and/or booster composition containing 72 weight percent of the first composition of Example 3 and 28 weight percent of a second auto-ignition booster (AIB) composition. The AIB composition may be formed for example, as described in U.S. Pat. No. 8,273,199, herein incorporated by reference in its entirety. The second auto-ignition booster composition contains 30 weight percent of 5-aminotetrazole, 10 weight percent of potassium 5-aminotetrazole, 55 weight percent of potassium nitrate, and five weight percent of molybdenum trioxide, said weight percents of the second auto-ignition booster composition taken by the total weight of the second auto-ignition booster composition. The percentages of the first composition of Example 3 and the second AIB composition, are taken by weight of the total ignition and/or booster composition. The ignition and/or booster composition was comminuted and dry-mixed to form a substantially evenly distributed or homogeneous solid mixture. The composition was placed in an identical inflator of Example 1 having an identical igniter of Example 1, and ignited. The time to first gas at 85 C was 3.5 milliseconds. The time to first gas at −40 C was 4.5 milliseconds.

EXAMPLE 5

A composition containing boron carbide at 17.5 weight percent, guanidine nitrate at 17.5 weight percent, and potassium nitrate at 65.00 weight percent, the percentages taken by weight of the total composition, was comminuted and dry-mixed to form a substantially evenly distributed or homogenous solid mixture. The average particle size of the boron carbide was 5.8 micrometers. The composition was placed in an identical inflator of Example 1 having an identical igniter of Example 1, and ignited. The time to first gas at 85 C was 3.9 milliseconds. The time to first gas at −40 C was 6.0 milliseconds. The Bruceton impact sensitivity of this composition was greater than 15 inches. The friction sensitivity was greater than 360 N.

EXAMPLE 6

A composition containing boron carbide at 17.5 weight percent, guanidine nitrate at 17.5 weight percent, and potassium nitrate at 65.00 weight percent, the percentages taken by weight of the total composition, was comminuted and dry-mixed to form a substantially evenly distributed or homogenous solid mixture. The average particle size of the boron carbide was 5.8 micrometers. The composition was placed in an identical inflator of Example 1 having an identical igniter of Example 1, and ignited. The time to first gas at 85 C was 5.2 milliseconds. The time to first gas at 23 C was 8.1 milliseconds. The time to first gas at −40 C was 11.9 milliseconds.

EXAMPLE 7

A composition containing boron carbide at 17.5 weight percent, guanidine nitrate at 17.5 weight percent, and potassium nitrate at 65.00 weight percent, the percentages taken by weight of the total composition, was comminuted and dry-mixed to form a substantially evenly distributed or homogenous solid mixture. The average particle size of the boron carbide was 10.6 micrometers. The composition was placed in an identical inflator of Example 1 having an identical igniter of Example 1, and ignited. The time to first gas at 85 C was 6.8 milliseconds. The time to first gas at 23 C was 14.5 milliseconds. The time to first gas at −40 C was 22.0 milliseconds.

EXAMPLE 8

A composition containing boron carbide at 20.0 weight percent, polyvinyl alcohol at 5.0 weight percent, and potassium perchlorate at 75.00 weight percent, the percentages taken by weight of the total composition, was comminuted and dry-mixed to form a substantially evenly distributed or homogenous solid mixture. The composition was placed in an identical inflator of Example 1 having an identical igniter of Example 1, and ignited. The time to first gas at 85 C was 4.0 milliseconds. The time to first gas at −40 C was 10.4 milliseconds.

EXAMPLE 9

A composition containing boron carbide at 17.10 weight percent, guanidine nitrate at 12.50 weight percent, potassium perchlorate at 45.40 weight percent, and potassium nitrate at 25.00 weight percent, the percentages taken by weight of the total composition, was comminuted and dry-mixed to form a substantially evenly distributed or homogenous solid mixture. The composition was placed in an identical inflator of Example 1 having an identical igniter of Example 1, and ignited. The time to first gas at 85 C was 6.0 milliseconds. The time to first gas at 23 C was 11.0 milliseconds. The time to first gas at −40 C was 24.4 milliseconds. The Bruceton impact sensitivity of this composition was greater than 15 inches. The friction sensitivity was greater than 360 N.

EXAMPLE 10

A composition containing boron carbide at 16.00 weight percent, ammonium dinitrosalicylic acid at 12.50 weight percent, and potassium nitrate at 71.50 weight percent, the percentages taken by weight of the total composition, was comminuted and dry-mixed to form a substantially evenly distributed or homogenous solid mixture. The composition was placed in an identical inflator of Example 1 having an identical igniter of Example 1, and ignited. The time to first gas at −40 C was 8.5 milliseconds. The Bruceton impact sensitivity of this composition was greater than 15 inches. The friction sensitivity was greater than 360 N.

EXAMPLE 11

A composition containing boron carbide at 16.00 weight percent, ammonium dinitrosalicylic acid at 12.50 weight percent, and potassium nitrate at 71.50 weight percent, the percentages taken by weight of the total composition, was comminuted and dry-mixed to form a substantially evenly distributed or homogenous solid mixture. The composition was placed in an identical inflator of Example 1 having an identical igniter of Example 1, and ignited. The time to first gas at −40 C was 9.9 milliseconds. The Bruceton impact sensitivity of this composition was greater than 15 inches. The friction sensitivity was greater than 360 N.

EXAMPLE 12

A composition containing boron carbide at 16.00 weight percent, mono-ammonium salt of bis-tetrazole amine (BTA) at 12.50 weight percent, and potassium nitrate at 71.50 weight percent, the percentages taken by weight of the total composition, was comminuted and dry-mixed to form a substantially evenly distributed or homogenous solid mixture. The composition was placed in an identical inflator of Example 1 having an identical igniter of Example 1, and ignited. The time to first gas at −40 C was 9.6 milliseconds. The Bruceton impact sensitivity of this composition was greater than 15 inches. The friction sensitivity was greater than 360 N.

EXAMPLE 13

A composition containing boron carbide at 15.00 weight percent, 5-aminotetrazole at 10.00 weight percent, potassium 5-aminotetrazole at 5.00 weight percent, potassium nitrate at 65.00 weight percent, and molybdenum trioxide at 5.00 weight percent, the percentages taken by weight of the total composition, was comminuted and dry-mixed to form a substantially evenly distributed or homogenous solid mixture. The composition was placed in an identical inflator of Example 1 having an identical igniter of Example 1, and ignited. The time to first gas at 85 C was 3.3 milliseconds. The time to first gas at 23 C was 4.8 milliseconds. The time to first gas at −40 C was 6.5 milliseconds. The Bruceton impact sensitivity of this composition was greater than 15 inches. The friction sensitivity was about 80 N.

EXAMPLE 14

A composition containing 75 weight percent of a first composition containing potassium perchlorate at 77.50 weight percent and boron carbide at 22.50 weight percent, and, 25 weight percent of a second composition containing an AIB composition as described in Example 4 (the percentages taken by weight of the total composition) was comminuted and dry-mixed to form a substantially evenly distributed or homogeneous solid mixture. The composition was placed in an identical inflator of Example 1 having an identical igniter of Example 1, and ignited. The time to first gas at 85 C was 3.1 milliseconds. The time to first gas at 23 C was 3.6 milliseconds. The time to first gas at −40 C was 4.0 milliseconds.

EXAMPLE 15

A composition containing boron carbide at 17.00 weight percent, guanidine nitrate at 13.00 weight percent, potassium perchlorate at 67.00 weight percent, and iron oxide at 5.00 weight percent, the percentages taken by weight of the total composition, was comminuted and dry-mixed to form a substantially evenly distributed or homogenous solid mixture. The composition was placed in an identical inflator of Example 1 having an identical igniter of Example 1, and ignited. The time to first gas at 85 C was 10.4 milliseconds. The time to first gas at 23 C was 26.3 milliseconds. The time to first gas at −40 C was 53.3 milliseconds. The Bruceton impact sensitivity of this composition was greater than 15 inches. The friction sensitivity was greater than 360 N.

As shown in FIG. 1, in a first embodiment of a gas generator or inflator 10 of the present invention, an exemplary inflator utilizing a composition or compound of the present invention may incorporate a single chamber design. In general, an inflator containing an ignition and/or booster composition 12 formed as provided herein and in accordance with the present invention, may be provided, and may be manufactured as known in the art. A primary gas generating compound or composition 14 as described herein is also provided as shown in FIG. 1. U.S. Pat. Nos. 6,422,601, 6,805,377, 6,659,500, 6,749,219, and 6,752,421 exemplify typical airbag inflator designs and are each incorporated herein by reference in their entirety.

Figure 2:
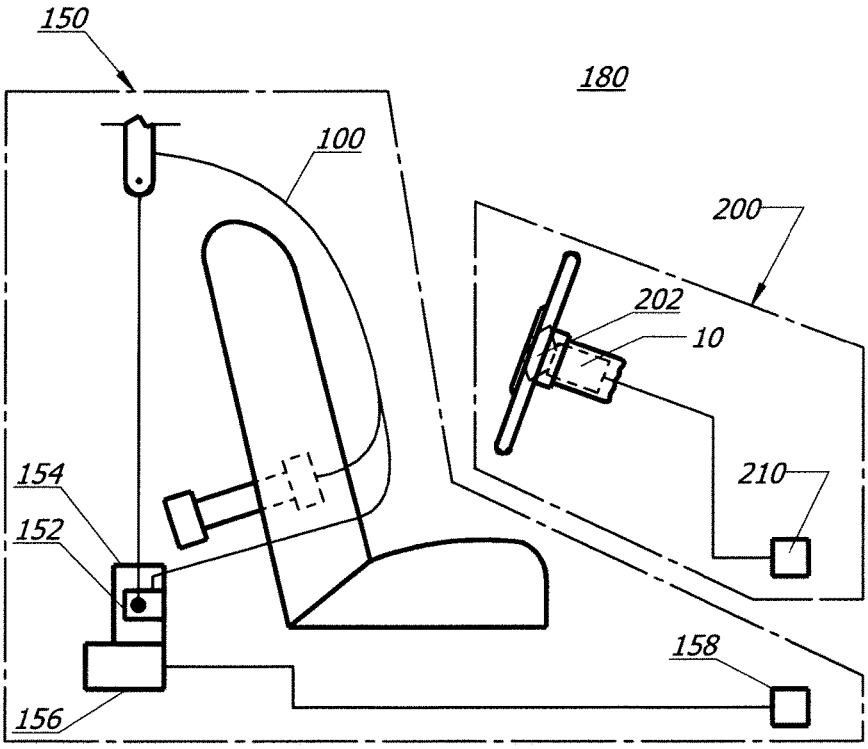
FIG. 2 is an exemplary vehicle occupant protection system containing the gas generator of FIG. 1.

Referring now to FIG. 2, the exemplary inflator 10 described above may also be incorporated into an airbag system 200. Airbag system 200 includes at least one airbag 202 and an inflator 10 containing an ignition and/or booster composition 12 in accordance with the present invention, coupled to airbag 202 so as to enable fluid communication with an interior of the airbag. Airbag system 200 may also include (or be in communication with) a crash event sensor 210. Crash event sensor 210 includes a known crash sensor algorithm that signals actuation of airbag system 200 via, for example, activation of airbag inflator 10 in the event of a collision.

Referring again to FIG. 2, airbag system 200 may also be incorporated into a broader, more comprehensive vehicle occupant restraint system 180 including additional elements such as a safety belt assembly 150. FIG. 2 shows a schematic diagram of one exemplary embodiment of such a restraint system. Safety belt assembly 150 includes a safety belt housing 152 and a safety belt 100 extending from housing 152. A safety belt retractor mechanism 154 (for example, a spring-loaded mechanism) may be coupled to an end portion of the belt. In addition, a safety belt pretensioner 156 containing ignition and/or booster composition 12 may be coupled to belt retractor mechanism 154 to actuate the retractor mechanism in the event of a collision. Typical seat belt retractor mechanisms which may be used in conjunction with the safety belt embodiments of the present invention are described in U.S. Pat. Nos. 5,743,480, 5,553,803, 5,667,161, 5,451,008, 4,558,832 and 4,597,546, each incorporated herein by reference. Illustrative examples of typical pretensioners with which the safety belt embodiments of the present invention may be combined are described in U.S. Pat. Nos. 6,505,790 and 6,419,177, incorporated herein by reference.

Safety belt assembly 150 may also include (or be in communication with) a crash event sensor 158 (for example, an inertia sensor or an accelerometer) including a known crash sensor algorithm that signals actuation of belt pretensioner 156 via, for example, activation of a pyrotechnic igniter (not shown) incorporated into the pretensioner. U.S. Pat. Nos. 6,505,790 and 6,419,177, previously incorporated herein by reference, provide illustrative examples of pretensioners actuated in such a manner.

It should be appreciated that safety belt assembly 150, airbag system 200, and more broadly, vehicle occupant protection system 180 exemplify but do not limit gas generating systems contemplated in accordance with the present invention.

The present description is for illustrative purposes only, and should not be construed to limit the breadth of the present invention in any way. Thus, those skilled in the art will appreciate that various modifications could be made to the presently disclosed embodiments without departing from the scope of the present invention as defined in the appended claims.

What is claimed is:

1. A composition comprising:

a boron-containing compound selected from the group consisting of boron carbide, a metal boride, or a mixture thereof;

an oxidizer selected from the group consisting of at least one metal nitrate, metal nitrite, metal perchlorate, metal chlorate, metal oxide, and mixtures thereof; and a secondary fuel, wherein said secondary fuel is selected from the group consisting of tetrazoles, triazoles, carboxylic acids, hydrazides, triazines, urea derivatives, guanidines, salts thereof or mixtures thereof; wherein the composition is free of ammonium nitrate and ammonium perchlorate.

2. The composition of claim 1, wherein the boron-containing compound is provided at 5-30 weight percent of the total composition.

3. The composition of claim 1 wherein the boron-containing compound selected from the group consisting of a metal boride comprising titanium boride, tungsten boride, magnesium boride, nickel boride, or a mixture thereof.

4. The composition of claim 1, wherein the boron-containing compound comprises boron carbide.

5. The composition of claim 1, wherein the oxidizer is provided at 40-95 weight percent of the total composition.

6. The composition of claim 1, wherein the oxidizer comprises potassium nitrate.

7. The composition of claim 1, wherein the secondary fuel is provided at 0.1-30 weight percent of the total composition.

8. The composition of claim 1 wherein said secondary fuel is selected from the group consisting of mono-ammonium bis-tetrazole amine, 5-aminotetrazole, guanidine nitrate, d,1-tartaric acid, nitroguanidine, 5,5'-bis-1H-tetrazole, di-ammonium salt of 5'5-bis-1H-tetrazole, ammonium dinitrosalicylic acid, and mixtures thereof.

9. A gas generator comprising the composition of claim 1.

10. A vehicle occupant protection system comprising the composition of claim 1.

11. The composition of claim 1, wherein the boron-containing compound is provided at 10-30 weight percent of the total composition.

12. The composition of claim 11, wherein the boron-containing compound is boron carbide.

13. The composition of claim 11, wherein the oxidizer is provided at 70-90 weight percent of the total composition.

14. The composition of claim 11, wherein said oxidizer is selected from the group consisting of potassium perchlorate, potassium nitrate, and mixtures thereof.

15. A gas generator containing the composition of claim 11.

16. A vehicle occupant protection system containing the composition of claim 11.

* * * * *